United States Patent [19]

Komatsu et al.

[11] Patent Number: 4,743,494

[45] Date of Patent: May 10, 1988

[54] PROCESS FOR PRODUCING HYDROPHILIC POLYOLEFIN NONWOVEN FABRIC

[75] Inventors: Masato Komatsu; Kiyotada Narukawa, both of Saitama; Noboru Yamamoto, Tokyo, all of Japan

[73] Assignee: Toa Nenryo Kogyo Kabushiki Kaisha, Tokyo, Japan

[21] Appl. No.: 936,410

[22] Filed: Dec. 1, 1986

[51] Int. Cl.[4] ..... B05D 1/08

[52] U.S. Cl. ..... 428/224; 156/622; 427/423

[58] Field of Search ..... 428/224; 427/255.2, 427/423; 156/62.2

[56] References Cited

FOREIGN PATENT DOCUMENTS 58-94752 6/1983 Japan .
58-179240 10/1983 Japan .

*Primary Examiner*—Marion C. McCamish
*Attorney, Agent, or Firm*—J. F. Hunt

[57] ABSTRACT

A process for producing a hydrophilic polyolefin nonwoven fabric which comprises treating with a plasma a nonwoven fabric composed of fibers of a polyolefin containing more than 0.1 parts by weight of hindered amine compound for 100 parts by weight of polyolefin.

15 Claims, No Drawings

PROCESS FOR PRODUCING HYDROPHILIC POLYOLEFIN NONWOVEN FABRIC

BACKGROUND OF THE INVENTION

The present invention relates to a process for producing a hydrophilic polyolefin nonwoven fabric which comprises treating with a plasma a nonwoven fabric of fibers of a polyolefin containing a hindered amine compound.

Nonwoven fabrics of polyolefin fibers have found use in a broad range of applications as battery separator, filter, packaging material, construction material, sanitary napkin, and so on. Being hydrophobic, polyolefin nonwoven fabrics are required to be made hydrophilic when they are used as, for example, battery separators which should have a hydrophilic nature. To impart the hydrophilic nature, the nonwoven fabric is impregnated with a surface active agent in the final stage of production, or the nonwoven fabric is sprayed with an aqueous solution of surface active agent immediately after the fibers have been extruded from the nozzle in the intermediate stage of production. The nonwoven fabrics made hydrophilic in this way have a disadvantage in that the surface active agent is lost during use for a long period of time and the hydrophilic nature becomes poor.

In order to keep the hydrophilic nature, there was proposed a process for treating a polyolefin nonwoven fabric with a plasma (Japanese Patent Laid-open No. 94752/1983). The plasma treated polyolefin nonwoven fabric maintains its hydrophilic nature over a long period of time; however, the plasma treatment takes a long time and is poor in productivity. On the other hand, there is disclosed in Japanese Patent Laid-open No. 179240/1983 a process for improving the bondability of polyolefin moldings containing a hindered amine by means of plasma treatment. This process, however, does not improve the hydrophilic nature of nonwoven fabrics composed of fine fibers of polyolefin.

SUMMARY OF THE INVENTION

The present invention provides a process for producing a hydrophilic polyolefin nonwoven fabric by treating a polyolefin nonwoven fabric with a plasma for a short time.

In order to reduce the time for plasma treatment performed in the production of a hydrophilic polyolefin nonwoven fabric and also to produce a polyolefin nonwoven fabric having superior hydrophilic nature, the present inventors carried out a series of researches, which led to the finding that only a short treatment is needed if a nonwoven fabric is made from a polyolefin which has previously been incorporated with a hindered amine compound and subsequently the resulting nonwoven fabric is treated with a plasma. The present invention is based on this finding.

DESCRIPTION OF THE PREFERRED EMBODIMENT

The gist of this invention resides in a process for producing a hydrophilic polyolefin nonwoven fabric which comprises treating with a plasma a nonwoven fabric comprised of fibers of a polyolefin containing more than 0.1 parts by weight, preferably 0.1 to 2 parts by weight, of a hindered amine compound per 100 parts by weight of polyolefin.

The polyolefin used in this invention included homopolymers of alpha-olefin such as ethylene, propylene, 1-butene, and 4-methylpentene; copolymers comprised of said alpha-olefins and an unstatured carboxylic acid or a derivative or vinyl ester thereof or an unsaturated aromatic compound such as vinyl monomer. The copolymer includes block copolymers, random copolymers, and graft copolymers. Preferred polyolefins are homopolypropylene and propylene copolymers such as propylene ethylene random or block copolymer and propylene-1-butene random or block copolymer.

The hindered amine compound used in this invention includes, for example, bis(2,2,6,6-terramethyl-4-piperidyl)sebacate, 4-benzoyloxy-2,2,6,6-tetramethylpiperidine, bis(2,2,6,6-tetramethyl-4-piperidyl)-1-(3,5-di-tertiary-butyl-4-hydroxyphenylmethyl)-1,1-pentanedicarboxylate, 1,4-di-(2,2,6,6-tetramethyl-4-piperidyl)-2,3-butanedione, bis(1,2,2,6,6-pentamethyl-4-piperidyl)sebacate, a condensation product of dimethyl succinate and 1-(2-hydroxyethyl)-4-hydroxy-2,2,6,6-tetramethylpiperidine (having a molecular weight greater than 3,000), poly[[6-(1,1,3,3-tetramethylbutyl)amino-1,3,5-triazine-2,4-diyl][(2,2,6,6-tetramethyl-4-piperidyl-)imino]hexamethylene[2,2,6-tetramethyl-4-piperidyl-)imino]] (having a molecular weight greater than 2,500), tri-(4-acetoxy-2,2,6,6-tetramethylpiperidine)amine, and tetrakis(2,2,6,6-tetramethyl-4-methylpiperidyl)1,2,3,4-butanetetracarboxylate ester. Preferable among these hindered amine compounds are bis(2,2,6,6-tetramethyl-4-piperidyl)sebacate, bis(1,2,2,6,6-pentamethyl-4-piperidyl)sebacate, and 4-benzoyloxy-2,2,6,6-tetramethylpiperidine.

One or more hindered amino compounds are added in an amount more than 0.1 parts by weight, preferably 0.1 to 2 parts by weight, more preferably 0.5 to 1.5 parts by weight, for 100 parts by weight of polyolefin. With an amount less than 0.1 parts by weight, the hindered amine compound does not produce the effect of reducing the time for plasma treatment. On the other hand, the hindered amine compound in excess of 2 parts by weight does not produce any further effect and is uneconomical.

The hindered amine compound may be incorporated into a polyolefin in any manner. According to a preferred manner, a hindered amine compound is added to a polyolefin, followed by premixing, and the mixture is compounded at a temperature higher than the melting point of the polyolefin with an extruder, high speed mixture, Banbury mixer, continuous kneader, or roll mill commonly used in the polyolefin industry.

The polyolefins fibers constituting the nonwoven fabric in this invention should be as fine as possible. Extremely fine fibers are preferably where the nonwoven fabric is used as a battery separator. The diameter of the fibers constituting the nonwoven fabric of this invention varies depending on the sectional configuration. In the case of approximately circular section, the diameter should be smaller than 50 microns, preferably 1 to 20 microns. The thickness and basis weight of the nonwoven fabric varies depending on the intended use. The thickness should be 50 to 800 microns, and the basis weight should be 5 to 200 g/m$^2$, preferably 10 to 50 g/m$^2$. The nonwoven fabric composed of such polyolefin fibers may be produced by extruding a molten polyolefin from a die having small holes and collecting the extrudates in the fibrous form. Preferred methods are described in Japanese Patent Laid-open Nos. 48921/1974 and 46972/1975. According to these methods, which are called jet spinning method or melt blown method, the melt of a polyolefin is extruded from a die having small holes and the extruded fibers are drawn by a high speed air stream and blown against a wire net on which the blown fibers are collected.

According to this invention, the nonwoven fabric of polyolefin fibers is treated with a plasma. The plasma treatment is accomplished by bringing the above mentioned nonwoven fabric into contact with an active gas generated by exciting a low pressure oxidizing gas (e.g., oxygen) mixed with nitrogen, air, argon, or helium, by means of high frequency discharge or microwave discharge.

The conditions for plasma treatment are as follows: Output: 0.1 to 5 kW, preferably 0.5 to 2 kW; pressure: 0.1 to 10 Torr, preferably 0.5 to 5 Torr; and treating time: 10 to 30 seconds, preferably 10 to 30 seconds.

According to the process of this invention, it is possible to greatly reduce the time for plasma treatment to impart the hydrophilic nature to the nonwoven fabric of polyolefin fibers, and therefore it is possible to increase the productivity. The hydrophilic nature thus imparted to the nonwoven fabric remains unchanged for a long period of time.

The hydrophilic nonwoven fabric obtained according to the process of this invention is especially suitable as a battery separator which needs to be hydrophilic.

The invention is now described in more detail with reference to the following examples. The hydrophilic nature was evaluated in terms of the rate of water penetration.

Using a syringe, a prescribed amount of water is dropped at the center of a circle, 30 mm in radius, drawn on a piece of nonwoven fabric measuring 100 mm by 100 mm. The time required for the entire circle to be wetted is measured.

EXAMPLES 1 TO 12

One hundred parts by weight of propylene ethylene block copolymer (containing 7 wt% of ethylene and having an MFR of 9 g/10 min) was dryblended with one of the following hindered amine compounds in the ratio shown in Table 1.

(1) Bis(2,2,6,6-tetramethyl-4-piperidyl)sebacate (2) 4-Benzoyloxy-2,2,6,6-tetramethyl piperidine The resulting dryblend was melted and mixed at 220° C. using an extruder to yield a composition.

This composition was made into a polypropylene nonwoven fabric having an average fiber diameter of 20 microns and a basis weight of 15 g/m$^2$, according to the process described in Japanese Patent Laid-open No. 48921/1974.

The nonwoven fabric thus obtained was treated with a plasma for a prescribed period of time as shown in Table 1. The plasma treatment was carried out using a low temperature plasma apparatus (Model TMZ-2032 made by Toshiba) under the following conditions. Frequency: 2450 MHz, pressure: 1.0 Torr, output: 1.0 kW, and feed gas: air.

The plasma treated nonwoven fabric was examined for water penetration. The results are shown in Table 1.

COMPARATIVE EXAMPLES 1 TO 5

Polypropylene nonwoven fabrics were prepared in the same manner as in Examples except that the hindered amine compound was not added. The resulting nonwoven fabrics were treated with a plasma for varied lengths of time as shown in Table 1. In Comparative Example 5, the same procedure as in Example 3 was repeated except that the plasma treatment was not carried out. The resulting plasma treated nonwoven fabrics were examined for water penetrations. The results are shown in Table 1.

TABLE 1

| Example No. | Hindered amine compd. Kind | Hindered amine compd. Amount* | Duration of plasma treatment (sec) | Rate of water penetration (sec) |
|---|---|---|---|---|
| 1 | (1) | 0.1 | 20 | 65 |
| 2 | (1) | 0.5 | 20 | 50 |
| 3 | (1) | 1.0 | 20 | 35 |
| 4 | (1) | 1.5 | 20 | 15 |
| 5 | (1) | 1.5 | 10 | 25 |
| 6 | (1) | 1.5 | 30 | 20 |
| 7 | (1) | 1.0 | 60 | 20 |
| 8 | (1) | 1.0 | 300 | 10 |
| 9 | (2) | 0.1 | 20 | 75 |
| 10 | (2) | 1.5 | 20 | 18 |
| 11 | (2) | 2.0 | 20 | 15 |
| 12 | (2) | 2.5 | 20 | 15 |
| Comparative Example 1 | — | none | not treated | — |
| 2 | — | none | 20 | — |
| 3 | — | none | 60 | 180 |
| 4 | — | none | 300 | 30 |
| 5 | (1) | 1.0 | not treated | — |

*Parts by weight

EXAMPLES 13 TO 16 AND COMPARATIVE EXAMPLE 6

Nonwoven fabrics were prepared in the same manner as in Examples 1 to 4, except that the propylene ethylene block copolymer was replaced by low density polyethylene (having a density of 0.920 g/cm$^3$ and an MFR of 9 g/10 min). The resulting nonwoven fabrics were examined for water penetration. The results are shown in Table 2.

For comparison, a polyethylene nonwoven fabric containing no hindered amine compound was prepared and examined for water penetration after plasma treatment. The results are shown in Table 2.

TABLE 2

| Example No. | Hindered amine compd. Kind | Hindered amine compd. Amount* | Duration of plasma treatment (sec) | Rate of water penetration (sec) |
|---|---|---|---|---|
| 13 | (1) | 0.1 | 20 | 63 |
| 14 | (1) | 0.5 | 20 | 55 |
| 15 | (1) | 1.0 | 20 | 30 |
| 16 | (1) | 1.5 | 20 | 18 |
| Comparative Example 6 | — | none | 20 | ∞ |

*Parts by weight

We claim:

1. A nonwoven fabric of fibers of polyolefin, said fibers having a diameter of less than 50 microns, said fabric having a basis weight of 5 to 200 grams/m$^2$, said polyolefin containing more than 0.1 parts and no more than 2 parts by weight hindered amine compound per 100 parts by weight polyolefin, said fabric being plasma treated to impart a durable hydrophilic nature and being capable of being penetrated by water.

2. THe fabric of claim 1 wherein said fibers are about 1–20 microns.

3. The fabric of claim 1 having a thickness of about 50–800 microns.

4. The fabric of claim 1 having a basis weight of 10–50 grams/m$^2$.

5. A process for producing a hydrophilic polyolefin nonwoven fabric comprising treating with a plasma a nonwoven fabric comprised of fibers less than 50 microns in diameter of a polyolefin containing more than 0.1 and not more than 2 parts by weight hindered amine compound per 100 parts by weight polyolefin to render the fibers hydrophilic and thereby improve the water penetrability of the fabric.

6. The process of claim 1 wherein said polyolefin is an alpha-olefin homopolymer or copolymer.

7. The process of claim 1 wherein said polyolefin is polypropylene.

8. The process of claim 1 wherein said hindered amine compound is bis(2,2,6,6-tetramethyl-4-piperidyl)-sebacate.

9. The process of claim 1 wherein said hindered amine compound is bis(1,2,2,6,6-pentamethyl-4-piperidyl)sebacate.

10. The process of claim 1 wherein said hindered amine compound is 4-benzoyloxy-2,2,6,6-tetramethyl-piperidine.

11. The process of claim 1 wherein said polyolefin contains about 0.1 to 1.5 parts by weight hindered amine compound per 100 parts by weight polyolefin.

12. The process of claim 1 wherein said hindered amine compound and said polyolefin are compounded as a mixture above the melting point of said polyolefin.

13. In a process for producing a melt blown nonwoven fabric wherein a fiber-forming thermoplastic polymer resin is extruded from a die having small holes into a high speed air stream and said fibers are drawn and blown against a collector to form a fabric, the improvement comprising:

extruding from said small holes a polyolefin containing more than 0.1 and not more than 2 parts by weight hindered amine compound per 100 parts polyolefin and drawing fibers of less than about 50 microns diameter to form a hydrophilic nonwoven fabric having a basis weight of 5 to 200 grams/$m^2$.

14. The process of claim 13 further comprising plasma treating said nonwoven fabric to impart a hydrophilic nature.

15. The process of claim 13 wherein said fabric is 50–800 microns thick.

* * * * *